US005817994A

United States Patent [19]

Fried et al.

[11] Patent Number: 5,817,994

[45] Date of Patent: Oct. 6, 1998

[54] REMOTE FAIL-SAFE CONTROL FOR ELEVATOR

[75] Inventors: Gerald B. Fried, San Ramon, Calif.; Michael Mutal, Belleveue, Wash.

[73] Assignee: Otis Elevator Company, Farmington, Conn.

[21] Appl. No.: 927,578

[22] Filed: Sep. 8, 1997

Related U.S. Application Data

[63] Continuation of Ser. No. 509,397, Jul. 31, 1995, abandoned.

[51] Int. Cl.[6] ..... B66B 1/34

[52] U.S. Cl. ..... 187/391; 187/395; 187/299

[58] Field of Search ..... 187/299, 298, 187/392, 395, 413, 391

[56] References Cited

U.S. PATENT DOCUMENTS

| | | | |
|---|---|---|---|
| 4,561,093 | 12/1985 | Doane et al. | 371/20 |
| 4,655,324 | 4/1987 | Meguerdichian | 187/121 |
| 4,673,911 | 6/1987 | Yoshida | 187/100 |
| 4,685,538 | 8/1987 | Kamaike | 187/121 |
| 4,979,594 | 12/1990 | Begle | 187/121 |
| 5,042,621 | 8/1991 | Ovaska et al. | 187/393 |
| 5,081,628 | 1/1992 | Makekawa et al. | 371/34 |
| 5,202,540 | 4/1993 | Auer | 187/121 |
| 5,518,086 | 5/1996 | Tyni | 187/316 |
| 5,522,480 | 6/1996 | Hofmann | 187/391 |
| 5,554,832 | 9/1996 | Lumme et al. | 187/380 |
| 5,578,801 | 11/1996 | Hofmann | 187/393 |

FOREIGN PATENT DOCUMENTS

| | | | |
|---|---|---|---|
| 3-79578 | 4/1991 | Japan | 187/393 |
| 3-98970 | 4/1991 | Japan | 187/391 |
| 4-6990 | 1/1992 | Japan . | |
| 4-32477 | 2/1992 | Japan | 187/391 |
| 4-189283 | 7/1992 | Japan | 187/393 |
| 4-191271 | 7/1992 | Japan | 187/391 |
| 6-80339 | 3/1994 | Japan | 187/391 |

*Primary Examiner*—Robert Nappi

[57] ABSTRACT

A remote control arrangement (and method) for generating a car command remotely, includes a wireless transmitter and a wireless receiver which is coupled to an elevator controller. The receiver is detachably connected to wiring which leads to the controller. After finishing use of the transmitter/receiver arrangement, elevator service personnel detaches the receiver from the elevator wiring leading to the controller.

9 Claims, 8 Drawing Sheets

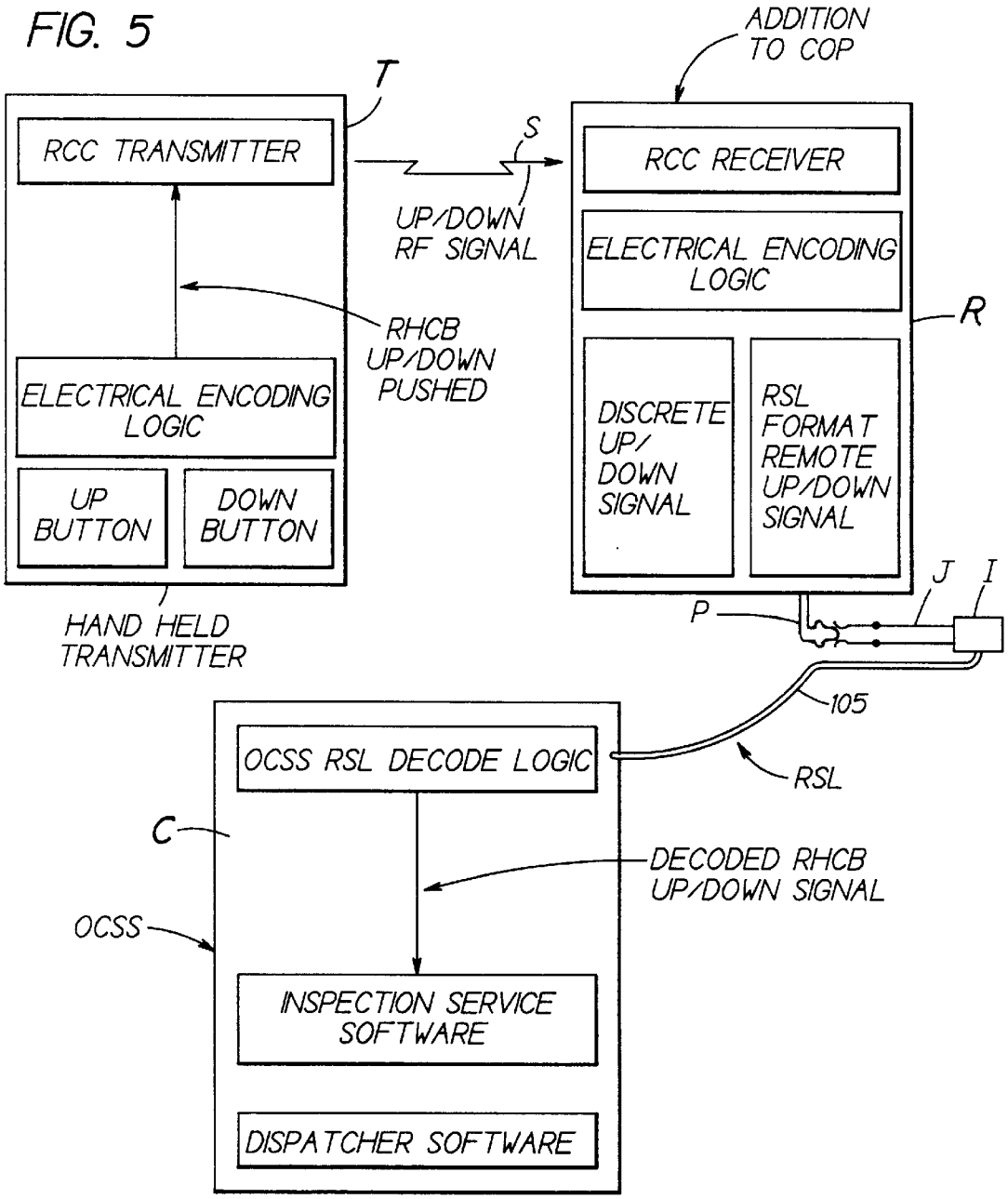
FIG. 5
T
RCC TRANSMITTER
ELECTRICAL ENCODING LOGIC
UP BUTTON
DOWN BUTTON
HAND HELD TRANSMITTER
S
UP/DOWN RF SIGNAL
RHCB UP/DOWN PUSHED
ADDITION TO COP
RCC RECEIVER
ELECTRICAL ENCODING LOGIC
DISCRETE UP/ DOWN SIGNAL
RSL FORMAT REMOTE UP/DOWN SIGNAL
R
J
I
P
105
RSL
OCSS RSL DECODE LOGIC
C
DECODED RHCB UP/DOWN SIGNAL
OCSS
INSPECTION SERVICE SOFTWARE
DISPATCHER SOFTWARE

REMOTE FAIL-SAFE CONTROL FOR ELEVATOR

This is a file wrapper continuation of application Ser. No. 08/509,397 filed on Jul. 31, 1995 now abandoned.

CROSS-REFERENCE TO RELATED APPLICATIONS

This application is related to commonly-owned, U.S. patent applications, Ser. Nos. 8/363,153 filed Dec. 23, 1994 entitled Remote Hall Call Registration for Elevator System (Attorney Docket OT-1398) and 8/401,642 filed Mar. 9, 1995 entitled Remote Group Configuration for Elevator System (Attorney Docket OT-1401), both by D. Richard Schafer.

BACKGROUND OF THE INVENTION

1. Technical Field

This invention relates to elevator control systems and, more particularly, to such systems including a remote control car command signal transmitter-receiver arrangement.

2. Description Of The Prior Art

Remote control (e.g., wireless) command signal arrangements for elevator systems are known. See, for example, U.S. Pat. No. 4,673,911, issued Jun. 16, 1987 entitled "Elevator Remote-Control Apparatus" to K. Yoshida; U.S. Pat. No. 4,979,594, issued Dec. 25, 1990 entitled "Method and Equipment for the Secure and Convenient Input of Control Commands, in Particular in Lift Installations" to G. Begle, et al.; U.S. Pat. No. 4,655,324, issued Apr. 7, 1987 entitled "Method for Privately Controlling an Elevator" to G. Meguerdichian, et al.; and U.S. Pat. No. 4,685,538, issued Aug. 11, 1987 entitled "Remote Call Registration System for Elevator" to H. Kamaike, which are all hereby incorporated in their entireties by reference.

However, in prior art wireless arrangements, there is the possibility that an unauthorized wireless signal (e.g., noise, undesired signals from other transmitters) may be received by the particular receiver and incorrectly recognized as an authorized signal. To reduce this possibility, various arrangements, e.g., authorized signal identification, are known.

SUMMARY OF THE INVENTION

It is a principal object of the present invention to reduce the possibility that an unauthorized wireless signal is recognized incorrectly as an authorized signal in an elevator system.

It is an additional object of the present invention to facilitate inspection service in an elevator system.

According to the present invention, an elevator control arrangement includes a remote car command (RCC) wireless transmitter (e.g., hand-held) similar to a garage door opener or a TV remote control, and a wireless receiver suitably connected in the car operating panel (COP) of an elevator car. The receiver is suitably (via plug-jack arrangement) electrically connected to proper wiring which is connected, for example, to well known circuits for operating the elevator car in inspection mode.

The transmitter has, e.g., two buttons: UP and DOWN. While pushed, each button transmits its own unique digital code (RCC signal) on, e.g., an rf (radio frequency) carrier. Of course, infrared or sonic signals can be employed and are particularly useful when elevator service personnel desire to operate the car in well known inspection mode. Inspection mode is initiated, for example, by operating a key switch on the COP, and removes the car from normal service so that the car will not answer hall/car calls, and permits operation of the car at a slow speed for inspection/service purposes.

The receiver electronically decodes the signal as "Remote Up Button Pushed" or "Remote Down Button Pushed". Two signal types are possible: discrete and encoded. The discrete signal is used to enable a relay, transistor, contactor, or similar device used in some existing elevator systems to signal the UP or DOWN movement to the motor control software contained in the controller. This feature makes the RCC arrangement useful for modernization projects. The encoded signal is compatible with, e.g., OTIS E411, OTIS modular elevator systems and other modular elevator systems. The encoded signal is sent via a remote serial link RSL to the appropriate controller software stored within the elevator controller.

Individual RCC transmitter-receiver arrangements are identical but may be configurable via, e.g., a set of jumpers located inside the transmitter and the receiver. This allows, for example, the maintenance person to configure a particular transmitter to control any number of cars or groups.

To use the RCC arrangement, the operator (e.g., maintenance personnel) continuously pushes an UP or DOWN button on the transmitter from a distance. The receiver decodes the digital pulse train sent over the rf carrier and passes the RCC signal to the appropriate elevator controller software. Of course, the arrangement may easily be constructed to operate by means of a single (i.e., non-continuous) push of the appropriate button, and/or by line of sight (e.g., infrared) technology.

The RCC arrangement offers a programmable method of response to UP/DOWN signals or special signals. Any standard response such as fire service, emergency service, etc. may be programmed and selected as a programmed response. This programming is field selectable and may be set in EEPROM in the controller software located in the machine room.

According to an essential feature of the present invention, the receiver R is connected to the elevator system, e.g., via a plug and jack (or similar easy connection/disconnection) arrangement. Therefore, service personnel can remove the receiver from the elevator system at the end of use by unplugging the receiver from its jack fixed into the car operating panel. Therefore, a method for controlling an elevator car according to the present invention includes connecting a wireless receiver to a car operating panel inside the car, transmitting a remote car command signal from outside the car to the wireless receiver inside the car and disconnecting the wireless receiver from the car operating panel. Disconnecting (e.g., electrically and/or physically) the wireless receiver from the elevator system reduces (e.g., eliminates) the possibility that an unauthorized wireless signal will be recognized through the wireless receiver.

Further and still other objects of the present invention will become more readily apparent in view of the following detailed description when taken in conjunction with the following drawing, in which:

BRIEF DESCRIPTION OF THE DRAWING

FIG. 5 is a schematic block diagram of an arrangement according to the present invention (R, T, P, I) coupled to the system of FIG. 1.

DETAILED DESCRIPTION OF THE PREFERRED EMBODIMENTS AND BEST MODE

Figure 1:
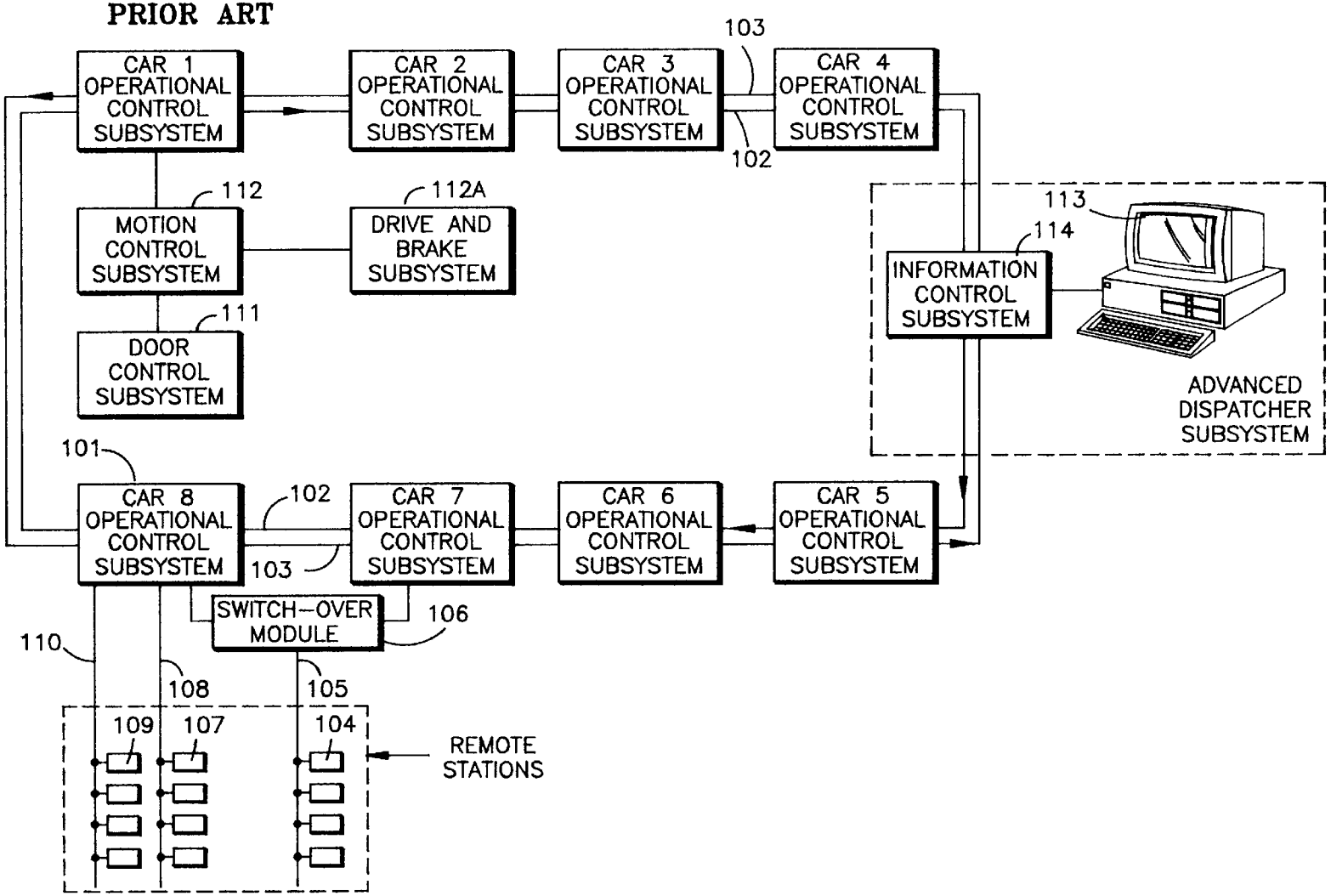
FIG. 1 PRIOR ART
FIG. 1 is a block diagram of an elevator system according to the prior art.
Figure 1A:
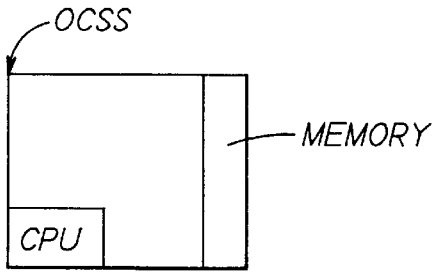
FIG. 1A PRIOR ART
Fig. 1A is a schematic diagram of an OCSS shown in FIG. 1.

FIG. 1 is a block diagram that depicts an elevator system of a type described in commonly owned U.S. Pat. No. 5,202,540 issued Apr. 13, 1993, entitled "Two-Way Ring Communication System for Elevator Group Control" to B. Auer, et al., which is hereby incorporated by reference. This elevator system presents but one suitable configuration of an elevator environment for practicing the present invention. As described therein, an elevator group control function may be distributed to separate data processors, such as microprocessors, on a per elevator car basis. These microprocessors, referred to herein as operational control subsystems (OCSS) 101, are coupled together with a two-way ring communication bus 102,103. For the illustrated embodiment, the elevator group consists of eight elevator cars (CAR 1–CAR 8) and, hence, includes eight OCSS 101 units.

For a given installation, a building may have more than one group of elevator cars. Furthermore, each group may include from one to some maximum specified number of elevator cars, typically a maximum of eight cars.

Hall buttons, for initiating elevator hall calls, and lights are connected with remote stations 104 and remote serial communication links 105 to each OCSS 101 via a switch-over module (SOM) 106. Elevator car buttons, lights, and switches are coupled through similar remote stations 107 and serial links 108 to the OCSS 101. Elevator car specific hall features, such as car direction and position indicators, are coupled through remote stations 109 and a remote serial link 110 to the OCSS 101.

It should be realized that each elevator car and associated OCSS 101 has a similar arrangement of indicators, switches, communication links and the like, as just described, associated therewith. For the sake of simplicity, only those associated with CAR 8 are shown in FIG. 1.

Car load measurement is periodically read by a door control subsystem (DCSS) 111, which is a component of a car controller system. The load measurement is sent to a motion control subsystem (MCSS) 112, which is also a component of the car controller system. The load measurement in turn is sent to the OCSS 101. DCSS 111 and MCSS 112 preferably include microprocessors for controlling the car door operation and the car motion, under the control of the OCSS 101. The MCSS 112 also works in conjunction with a drive and brake subsystem (DBSS) 112A.

A car dispatching function is executed by the OCSS 101, in conjunction with an advanced dispatcher subsystem (ADSS) 113, which communicates with each OCSS 101 through an information control subsystem (ICSS) 114. By example, the measured car load is converted into boarding and deboarding passenger counts by the MCSS 112 and sent to the OCSS 101. The OCSS 101 subsequently transmits this data over the communication buses 102,103 to the ADSS 113, via the ICSS 114. Also, by example, data from a hardware sensor mounted on the car's door frame may sense boarding traffic, and this sensed information is provided to the car's OCSS 101.

As such, it can be seen that the ICSS 114 function as a communication bus interface for the ADSS 113, which in turn influences high level elevator car control functions and parameters.

The ADSS 113 may also collect data on individual car and group demands throughout the day to arrive at a historical record of traffic demands for different time intervals for each day of the week. The ADSS 113 may also compare a predicted demand to an actual demand so as to adjust elevator car dispatching sequences to obtain an optimum level of group and individual car performance. Any well-known inspection service program is suitably stored within, e.g., the OCSS 101.

According to the present invention (FIGS. 4–8), a wireless receiver R is easily electrically (and preferably physically) attachable-detachable from the car via, e.g., plug P, jack J connected to any suitable interface I. The interface I is suitably connected (hard-wired) to a remote serial link (RSL) 105 to transmit up/down command signals to the controller c, e.g., the OSCC.

Figure 2:
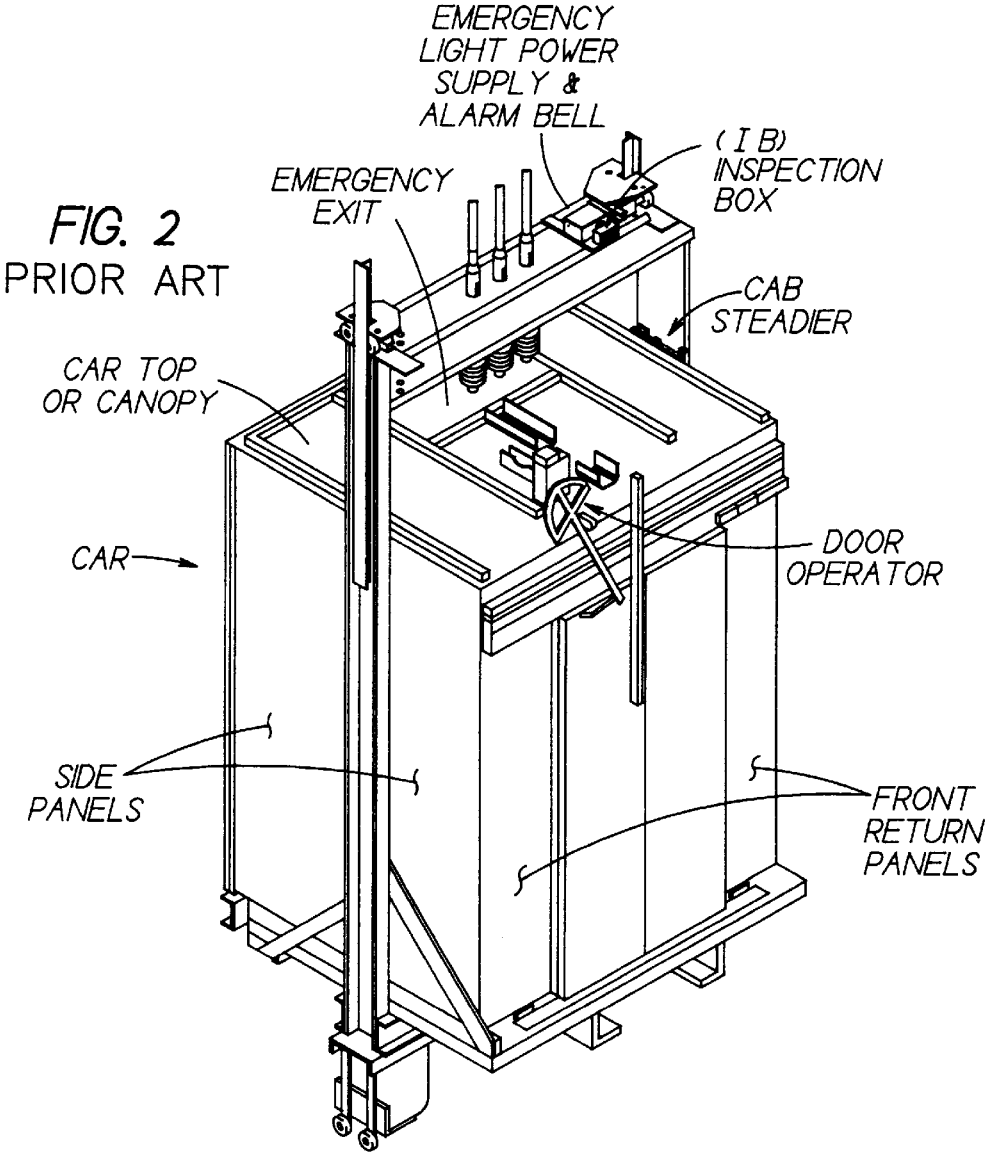
FIG. 2 PRIOR ART
FIG. 2 is a perspective view of an elevator car having an inspection box (IB) with switches/buttons for initiating up/down signals to the OCSS while on inspection mode, all according to the prior art.
Figure 3:
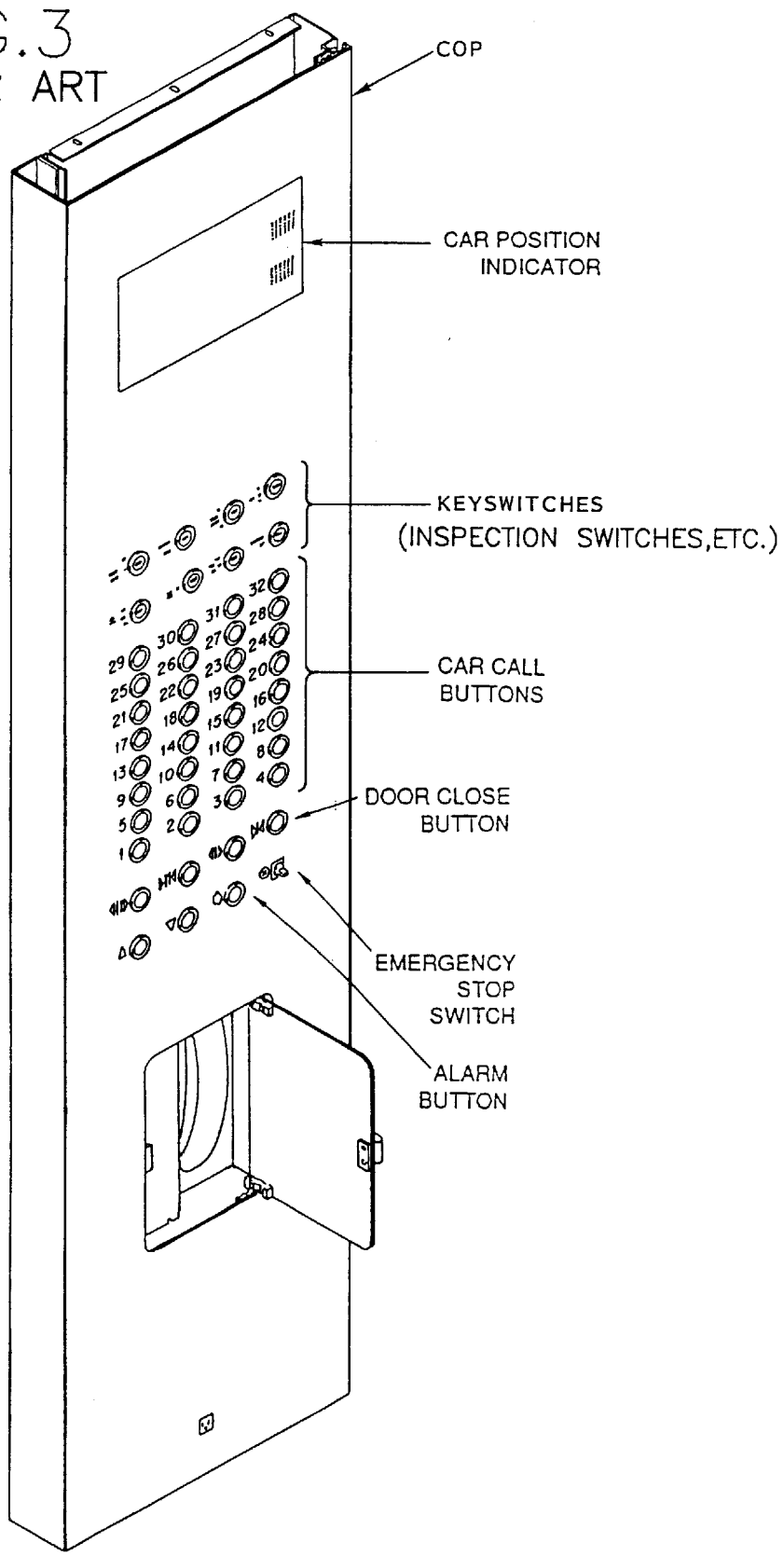
FIG. 3 PRIOR ART
FIG. 3 is a perspective view of a car operating panel having a key switch (IS) which causes a signal to remove the car from normal service and to enable the inspection box (IB) to control the car in inspection mode, according to the prior art.
Figure 3A:
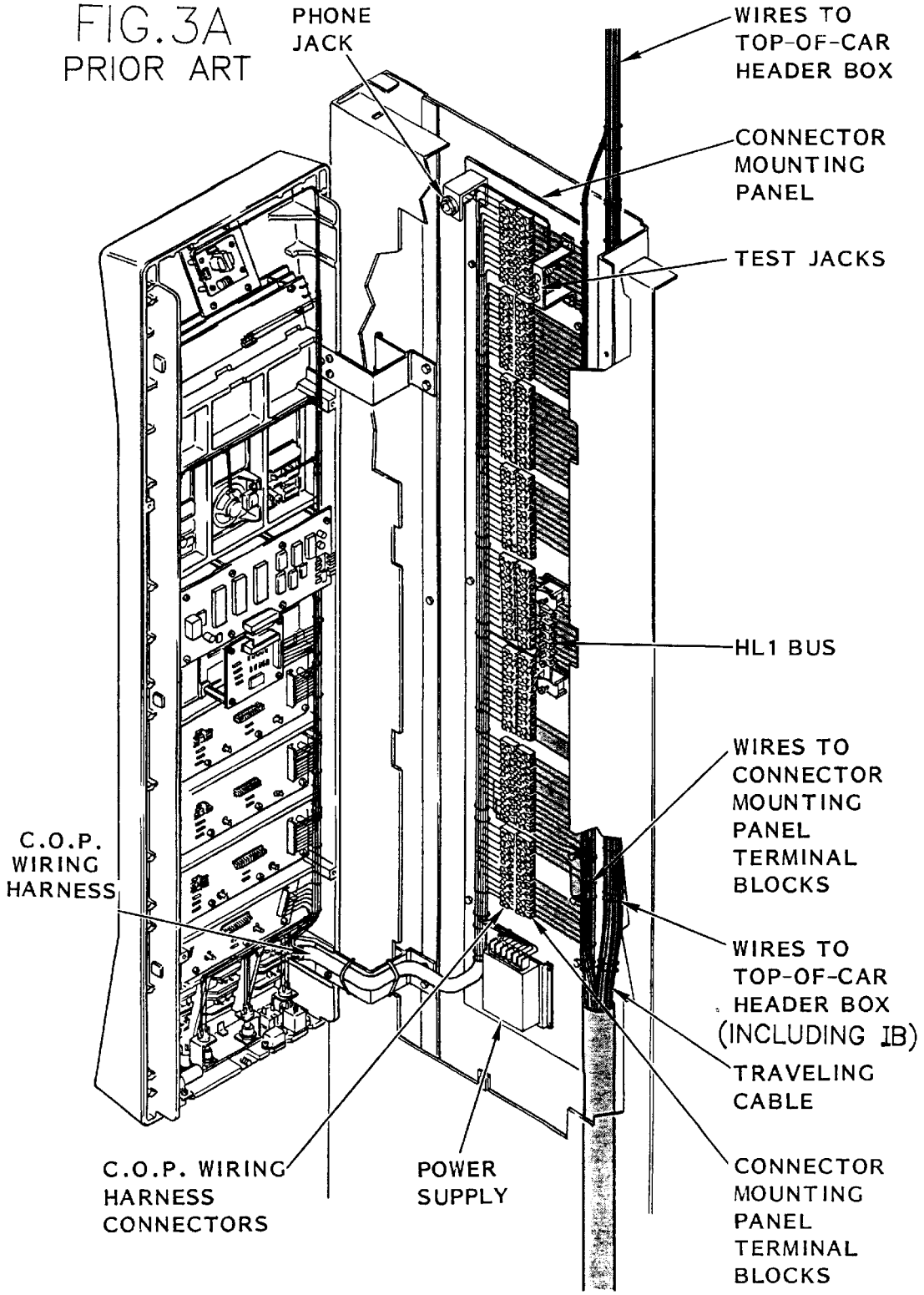
FIG. 3A PRIOR ART
FIG. 3A shows internal detail of the COP of FIG. 3, including wiring to the box IB, according to the prior art.
Figure 4:
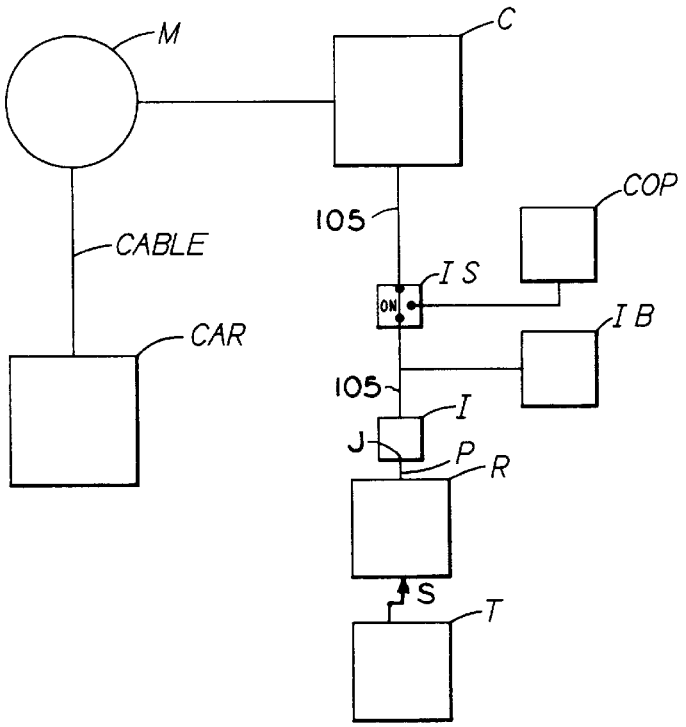
FIG. 4 is a schematic diagram of an elevator system, having a removable wireless receiver R for operating with a wireless transmitter T according to the present invention.
Figure 6:
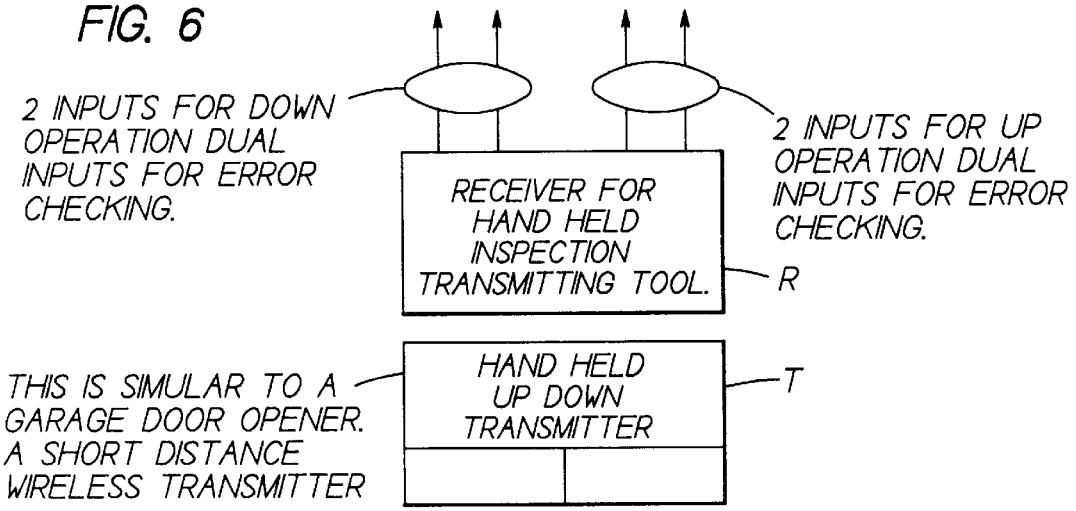
FIG. 6 is a schematic circuit diagram of the transmitter T and the receiver R of the present invention.
Figure 7:
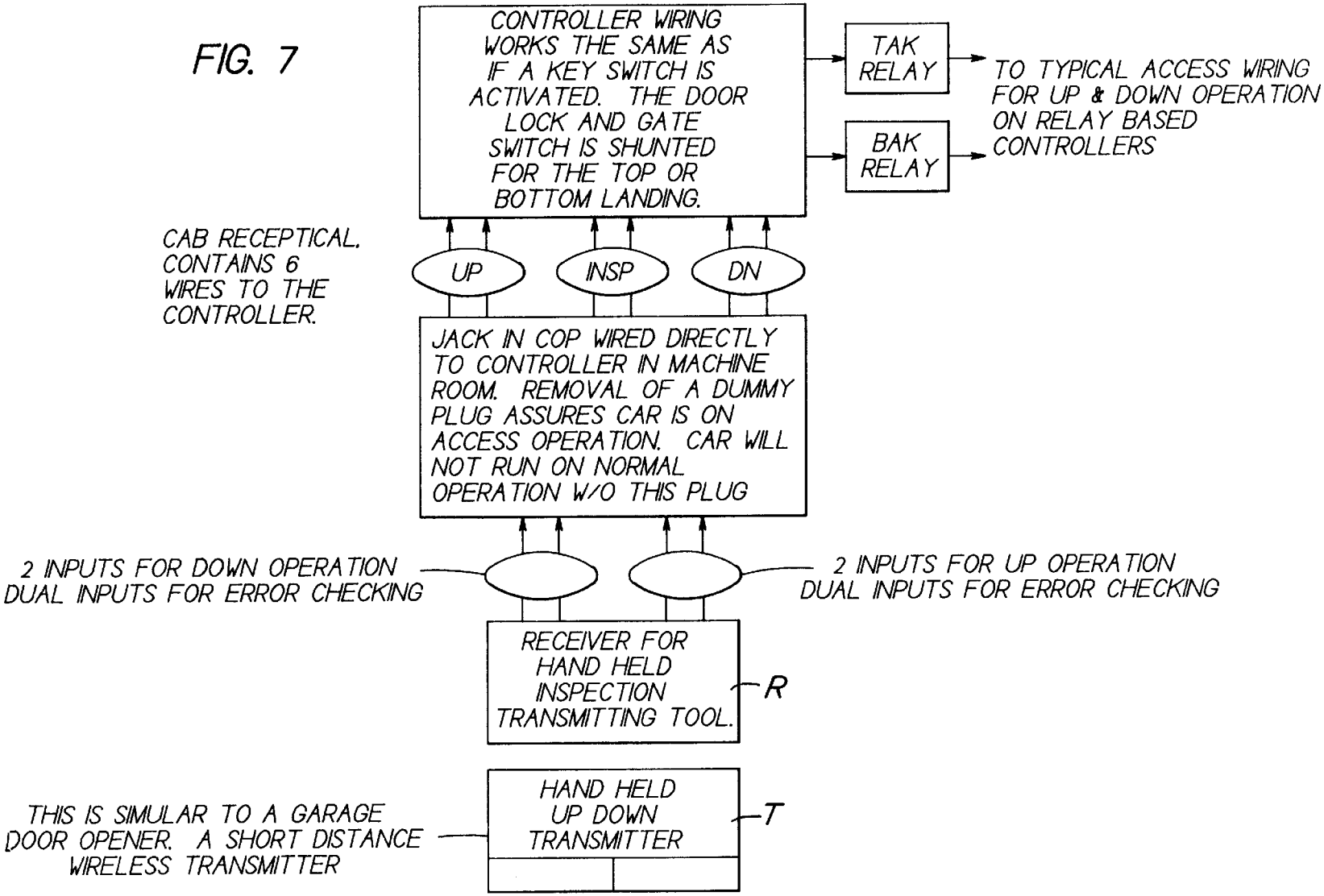
FIG. 7 is a schematic block diagram of the present invention with connections to a well-known relay based elevator system.
Figure 8:
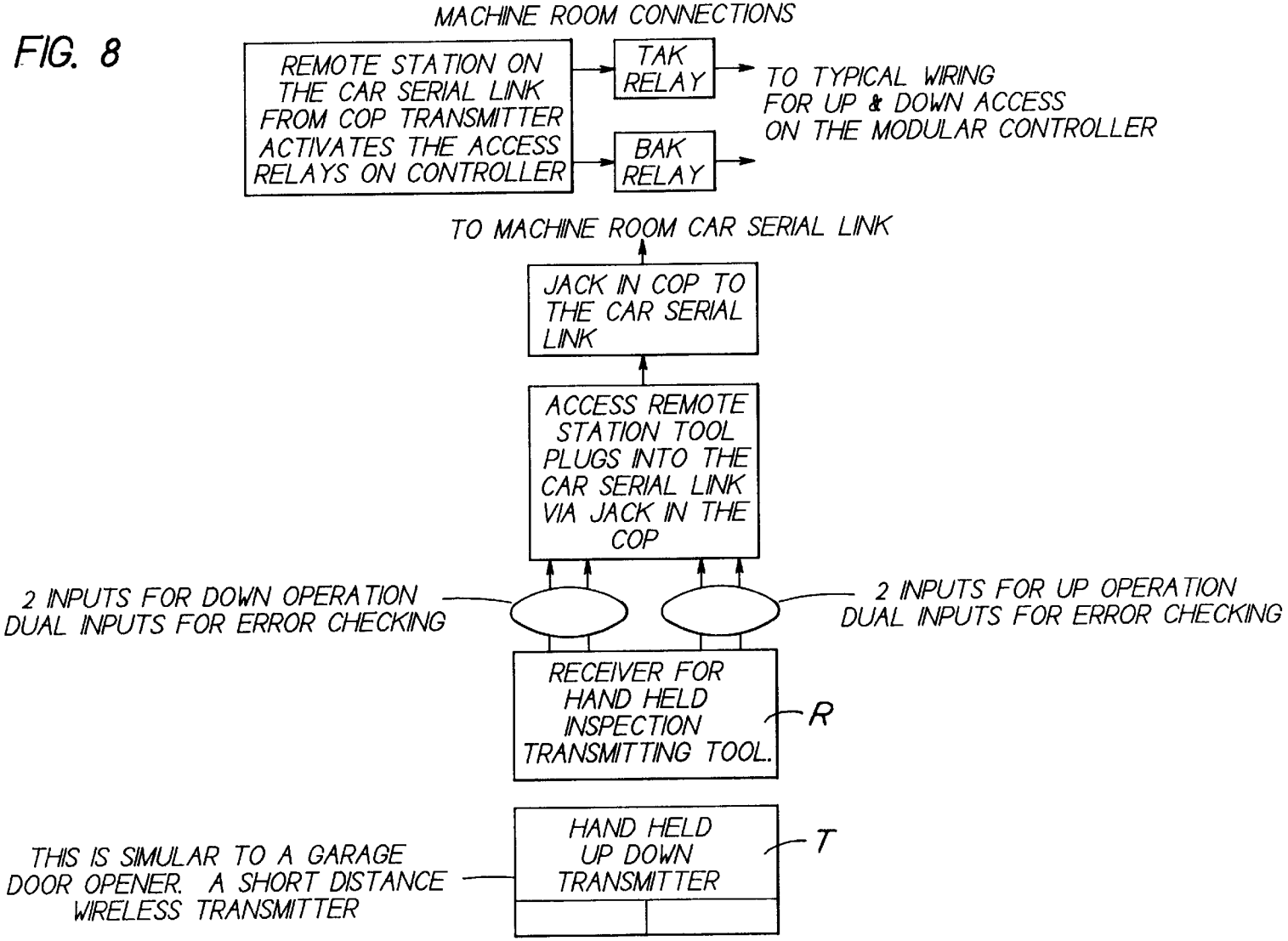
FIG. 8 is a schematic block diagram of the present invention with connections to the well-known modular control elevator system of FIG. 1.

A wireless transmitter T including suitable hardware/software for generating UP and DOWN command signals, encoding such signals and transmitting such signals via, for example, radio frequency carrier, communicates with the radio frequency receiver R located at the car operating panel (COP) (see FIG. 5). The receiver R is electronically removably attached to the panel via, e.g., a suitable plug P and a suitable jack J which are commercially available and need not be further discussed. After the unit T transmits an UP or DOWN command signal to the receiver R located in the car, the receiver R suitably decodes the UP/DOWN signal in any conventional fashion and, for example, re-encodes a signal for transmission tothe controller C, for example, the OCSS. See, for example, the previously incorporated U.S. Pat. No. 5,202,540. The OCSS includes either hardware or software decode logic (e.g., OCSS RSL decode logic) which ascertains that the signal received is a RCC signal. The RCC signal at the controller C is, for example, identical to known inspection service signals generated by means of the top-of-car inspection box IB (FIG. 2) when the inspection key switch IS (FIG. 3) is in an "ON" position (FIG. 4). Upon recognizing the RCC signal, the software in the controller C invokes an any well-known inspection service software routine. That routine causes motor M to move the car up/down at no greater than, e.g., 125 ft minute. While on inspection mode, the car does not answer car/hall calls. Preferably, the box IB is disabled while the receiver R is connected. In view of the instant disclosure, those skilled in the art will readily be able to implement the present invention. Regarding FIG. 7 and 8, for remote access operation for a typical relay-based controller (FIG. 7) and for Modular Control System (MCS), controller wiring for access key operation will utilize standard circuits. In the place of key switches. The door locks and gate switches are shunted by these relays be continuous pressure on the transmitter T. Two inputs must be made for each direction. Standard limit switches are always working.

While there has been shown and described what is at present considered preferred embodiments of the present invention, it will be apparent to those skilled in the art that various changes and modifications may be made therein without departing from the spirit and scope of the present invention which shall be limited only by the appended claims. For example, the arrangement can be modified to permit registration of hall or car calls remotely.

What is claimed is:

1. A method for controlling an elevator car, comprising:

connecting a wireless receiver to a car operating panel inside the car;

transmitting a remote car command signal from outside the to the wireless receiver inside the car;

sending the car command signal from the car operating panel to the car controller, controlling the elevator car responsive to the car command signal; and disconnecting the wireless receiver from the car controller.

2. A method as claimed in claim 1, further comprising removing an elevator car from normal service prior to said connecting step.

3. A method as claimed in claim 1, further comprising opening a hoistway door prior to said connecting step.

4. A method as in claim 1, wherein said transmitting step comprises transmitting a car command radio frequency signal to the wireless receiver.

5. A method as claimed in claim 1, wherein said controlling step comprises controlling the elevator car to move at a speed of not greater than approximately 125 feet per minute.

6. An elevator control system, comprising:

a controller including an electronic processor connected to a memory, a motor control routine stored within said memory, said motor control routine including instructions for detecting a control signal indicative of remote car command signal and for causing an elevator car to move in a direction associated with said signal;

a car operating panel inside the car electrically connected to said controller so as to provide the said remote car command signal to said controller;

a wireless transmitter outside the car for generating and transmitting said remote car command signal; and a wireless receiver inside the car for receiving said remote car command signal, said receiver being electronically detachably coupled to said car operating panel.

7. A control system as claimed in claim 6, wherein said transmitter includes circuits for generating and transmitting UP and DOWN signals.

8. A control system as claimed in claim 6, wherein said receiver is electronically and physically detachably coupled to said car operating panel.

9. A control system as claimed in claim 8, wherein a plug and jack arrangement electronically and physically detachably couples said wireless receiver to said car operating panel.

* * * * *